US005235951A

United States Patent [19]

Taguchi et al.

[11] Patent Number: 5,235,951

[45] Date of Patent: Aug. 17, 1993

[54] THROTTLE CONTROL APPARATUS

[75] Inventors: Yoshinori Taguchi, Kariya; Shinichiro Tanaka, Mishima; Keiji Aoki, Susono, all of Japan

[73] Assignees: Aisin Seiki Kabushiki Kaisha, Kariya; Toyota Jidosha Kabushiki Kaisha, Toyota, both of Japan

[21] Appl. No.: 958,744

[22] Filed: Oct. 9, 1992

[30] Foreign Application Priority Data

Oct. 12, 1991 [JP] Japan ..... 3-292165

[51] Int. Cl.[5] ..... F02D 11/10; F02D 41/22

[52] U.S. Cl. ..... 123/397; 123/399; 123/198 DB

[58] Field of Search ..... 123/361, 396, 397, 399, 123/198 DB, 198 DC

[56] References Cited

U.S. PATENT DOCUMENTS

| | | | |
|---|---|---|---|
| 4,519,360 | 5/1985 | Murakami | 123/399 |
| 4,892,071 | 1/1990 | Asayama | 123/396 X |
| 4,979,117 | 12/1990 | Hattori et al. | 123/399 X |
| 4,993,384 | 2/1991 | Wiggins et al. | 123/399 |
| 5,022,369 | 6/1991 | Terazawa | 123/399 |
| 5,048,485 | 9/1991 | Terazawa et al. | 123/399 |
| 5,074,267 | 12/1991 | Ironside et al. | 123/399 |
| 5,092,298 | 3/1992 | Suzuki et al. | 123/399 X |
| 5,163,402 | 11/1992 | Taguchi et al. | 123/399 X |

FOREIGN PATENT DOCUMENTS

| | | | |
|---|---|---|---|
| 51-23776 | 7/1976 | Japan . | |
| 59-190441 | 10/1984 | Japan . | |
| 60-122549 | 8/1985 | Japan . | |
| 60-159346 | 8/1985 | Japan . | |
| 61-8435 | 1/1986 | Japan . | |
| 61-142846 | 6/1987 | Japan . | |
| 113155 | 5/1988 | Japan | 123/399 |
| 159645 | 7/1988 | Japan | 123/399 |
| 272942 | 11/1988 | Japan | 123/399 |
| 1-178028 | 7/1989 | Japan . | |
| 2-252926 | 10/1990 | Japan . | |

*Primary Examiner*—Willis R. Wolfe

*Attorney, Agent, or Firm*—Burns, Doane, Swecker & Mathis

[57] ABSTRACT

The invention is directed to a throttle control apparatus for controlling an opening of a throttle valve in an internal combustion engine, in response to operation of an accelerator operating mechanism. The apparatus includes a motor, a clutch, and a control circuit which controls the clutch to selectively take one of a first position of the motor engaged with the throttle valve and a second position disengaged therefrom. There is provided a first detector for producing a first signal corresponding to an amount of operation of the accelerator operating mechanism. Also provided is a second detector for producing a second signal corresponding to an opening angle of the throttle valve. Independent of the control unit, it is determined in accordance with the first and second signals if there is an abnormality, in which the throttle valve opens at an angle more than a predetermined angle when the accelerator operating mechanism is positioned at its initial position. When the abnormality continues for more than a predetermined time period, a signal indicative of the abnormality will be produced, and the clutch will be caused to disengage the motor from the throttle valve. When the signal indicative of the abnormality is continuously produced after the clutch disengages the motor from the throttle valve, the supply of fuel to the engine will be cut off.

18 Claims, 6 Drawing Sheets

THROTTLE CONTROL APPARATUS

BACKGROUND OF THE INVENTION

1. Field of the Invention

The present invention relates to a throttle control apparatus mounted on an internal combustion engine, and more particularly to a throttle control apparatus which controls an opening of a throttle valve by a driving source such as a motor activated in response to operation of an accelerator operating mechanism, and which performs various control operations such as automatic speed control operation or the like.

2. Description of the Prior Art

In general, a throttle valve for use in an internal combustion engine is provided to regulate a mixture of fuel and air in a carburetor, or regulate an intake air flow in an electronic fuel injection control system so as to control the output of the internal combustion engine, and is so structured to gear with an accelerator operating mechanism including an accelerator pedal.

Conventionally, the accelerator operating mechanism has been mechanically connected to the throttle valve, whereas an apparatus for opening and closing the throttle valve, or controlling an opening of the throttle valve by a driving source such as a motor in response to operation of the accelerator pedal has been proposed recently. For example, Japanese Utility Model Laid-open Publication No. Sho 60-122549 discloses, as a prior art, a fuel injection system which detects a depressed amount of an accelerator pedal and an opening angle of a throttle valve, and which drives an actuator in accordance with a difference between the detected results to adjust the opening angle of the throttle valve to an angle corresponding to the depressed amount of the accelerator pedal. With respect to the prior art, it has been considered in the above-identified publication that there may be a case where it will become difficult to control the opening of the throttle valve in accordance with an accelerator pedal signal due to a malfunction of the actuator or a poor movement of a throttle valve by some reasons. In view of the case, proposed in the above-identified publication is an apparatus, wherein if it is determined that the difference between the accelerator pedal signal and the throttle valve signal exceeds a predetermined value and that the time period of the difference continuously exceeding the value is longer than a predetermined time period, the injection of fuel or the ignition to the engine will be stopped.

In the publication of 60-122549, however, when the accelerator pedal is in a depressed condition thereof, it is not necessarily appropriate to stop the injection of fuel or ignition provided that the time period of the difference exceeding the predetermined value is longer than the predetermined time period. In the case where the accelerator pedal is in the depressed condition, there may be many cases where the operation of the engine should be continued. Rather, it is appropriate to control the engine to lessen its power or stop it, only when the accelerator pedal has been released to return to its initial position.

The apparatus disclosed in the above-identified publication is so controlled that the engine is stopped when the time period of the difference exceeding the predetermined value exceeds the predetermined time period. However, this will cause too much operation in the case where only a small malfunction or the like has occurred so that the engine can be easily recovered therefrom. In this case, therefore, it is appropriate to disengage the actuator from the throttle valve temporarily, so as to enable the engine to operate immediately after it has been recovered.

SUMMARY OF THE INVENTION

Accordingly, it is an object of the present invention to provide a throttle control apparatus which engages a throttle valve with a device for operating it through a clutch mechanism, and which monitors its conditions in operation to determine if there is an abnormality provided that an accelerator operating mechanism is in its initial position.

It is another object of the present invention to provide a throttle control apparatus which operates the clutch mechanism to disengage the throttle valve from the device for operating it without stopping the engine immediately, when the abnormality lasts longer than a predetermined time period.

In accomplishing the above and other objects, a throttle control apparatus according to the present invention, which controls an opening of a throttle valve disposed in an internal combustion engine, in response to operation of an accelerator operating mechanism. The apparatus includes a throttle operating device for opening and closing the throttle valve in accordance with an amount of operation of the accelerator operating mechanism, a clutch mechanism which is disposed between the throttle operating device and the throttle valve for selectively taking one of a first position of the throttle operating device engaged with the throttle valve and a second position of the throttle operating device disengaged from the throttle valve, and a control unit which controls the clutch mechanism to selectively take one of the first position and the second position. The control unit is arranged to control the operation of the throttle operating device at least in response to the operation of the accelerator operating mechanism. As a result, as long as the accelerator operating mechanism is operated continuously, a predetermined throttle opening angle is ensured. Also provided are a first detector which detects the amount of operation of the accelerator operating mechanism to produce a first signal corresponding to the amount of operation of the accelerator operating mechanism, and a second detector which detects an opening angle of the throttle valve to produce a second signal corresponding to the opening angle of the throttle valve. Independent of the control unit, it is determined if there is an abnormality, in which the throttle valve opens at an angle more than a predetermined opening angle when the accelerator operating mechanism is positioned substantially at an initial position thereof, in accordance with the first signal and the second signal. When the abnormality continues for a period of time more than a predetermined time period, a signal indicative of the abnormality is produced. The clutch mechanism is caused to take the second position for disengaging the throttle operating device from the throttle valve when the signal indicative of the abnormality is produced.

Preferably, the apparatus is arranged to cause a fuel supply unit, which controls an amount of fuel supplied to the internal combustion engine, to cut off the supply of fuel to the engine, when the signal indicative of the abnormality is continuously produced after the clutch mechanism disengages the motor from the throttle valve. It is preferable in the apparatus that the clutch mechanism continues taking the second position for disengaging the throttle operating device from the throttle valve, and that the fuel supply unit continues cutting off the supply of fuel to the internal combustion engine, until an ignition switch for the engine is turned off.

The internal combustion engine may be provided with an automatic speed control system which automatically maintains a vehicle speed at a constant speed by controlling the throttle operating device, and it is preferable to prohibit the signal indicative of the abnormality from being produced during the automatic speed control system is operating to maintain the vehicle speed at the constant speed. The apparatus may be arranged to generate a reset signal for prohibiting the signal indicative of the abnormality from being produced for a predetermined period of time after the ignition switch is turned on. The first detector may comprise a plurality of sensors for use in an accelerator system including an accelerator sensor and an accelerator pedal switch, and the second detector may comprise a plurality of sensors for use in a throttle control system including a throttle sensor with a throttle idle switch, to provide a redundancy system, respectively.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 2:
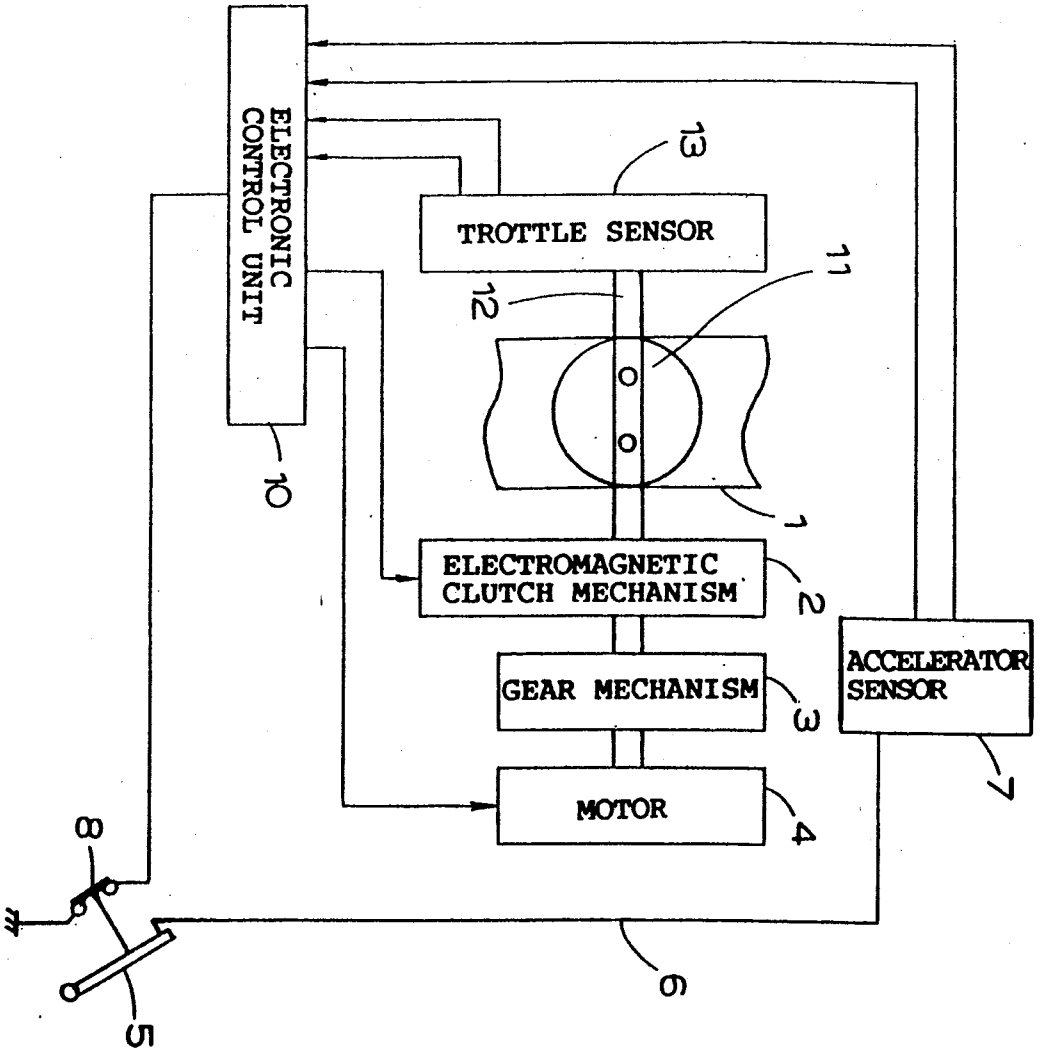
FIG. 2 is a general block diagram of a throttle control apparatus according to an embodiment of the present invention.

Referring to FIG. 2, there is illustrated a throttle control apparatus according to an embodiment of the present invention, wherein a throttle valve 11 is disposed in an intake duct of a throttle body 1 of an internal combustion engine (not shown) and fixed to a throttle shaft 12 which is rotatably mounted on the housing 1. The throttle shaft 12 has an end portion extending from the housing 1. Connected to the end portion is a return spring (not shown) which biases the throttle shaft 12 to close the throttle valve 11.

Linked to a tip end of the throttle shaft 12 is a throttle sensor 13 which detects an opening angle of the throttle valve 11 or a rotational angle of the throttle shaft 12. The rotational angle of the throttle shaft 12 is detected to produce a change in ohmic value of a variable resistor in response to the angle and convert it into a change in voltage by a potentiometer. Accordingly, a throttle position signal corresponding to the opening angle of the throttle valve 11 is fed from the throttle sensor 13 to an electronic control unit 10 (hereinafter, simply referred to as control unit 10). The throttle sensor 13 is also provided with a throttle idle switch (not shown), which turns off when the throttle valve 11 opens and which turns on when it is closed. That is, a throttle idle switch signal indicative of the fully closed position of the throttle valve 11 is fed to the control unit 10.

An accelerator sensor 7 is linked to an accelerator pedal 5, which constitutes an accelerator operating mechanism according to the present invention, through an accelerator cable 6. The accelerator sensor 7 is arranged to detect an accelerator operating amount to produce a change in ohmic value of a variable resistor in response to the amount and convert it into a change in voltage by a potentiometer. The accelerator sensor 7 is also provided with an accelerator idle switch (not shown). Accordingly, an accelerator position signal corresponding to a depressed amount of the acceleration pedal 5, i.e., the accelerator operating amount is fed to the control unit 10. The accelerator idle switch turns off when the accelerator pedal 5 is depressed, and turns on when it is not depressed. That is, an accelerator idle switch signal, which indicates the condition of the accelerator pedal 5 which is not depressed, is fed to the control unit 10. There is also provided an accelerator pedal switch 8 which operates directly in accordance with the depression of the accelerator pedal 5, and which turns on when the accelerator pedal 5 is not depressed, and turns off when it is depressed. In the present embodiment, therefore, the accelerator sensor 7 and the accelerator pedal switch 8 constitute a first detector according to the present invention, and the throttle sensor 13 constitute a second detector. In addition to these, various sensors may be disposed for detecting various conditions in each of an accelerator system and a throttle control system to thereby provide a redundancy system, respectively.

Linked to the other end of the throttle shaft 12 is an electromagnetic clutch mechanism 2, which is linked to a motor 4 through a gear mechanism 3. The motor 4 and gear mechanism 3 constitute the throttle operating device according to the present invention. Employed as the motor 4 is a step motor, for example, which is controlled by the control unit 10. Thus, when the motor 4 is rotated, the throttle valve 11 will be rotatable free from the motor 4, provided that the electromagnetic clutch mechanism 2 is not energized. When the electromagnetic clutch mechanism 2 is energized, the rotation of the motor 4 will be transmitted to the throttle valve 11 via the gear mechanism 3 to control the opening angle of the throttle valve 11 in response to the rotated amount of the motor 4. In the case where the throttle valve 11 is in its open position, if the electromagnetic clutch mechanism 2 is de-energized, the throttle valve 11 will return to a fully closed position, i.e., its initial position, by means of a biasing force of a return spring (not shown).

Figure 1:
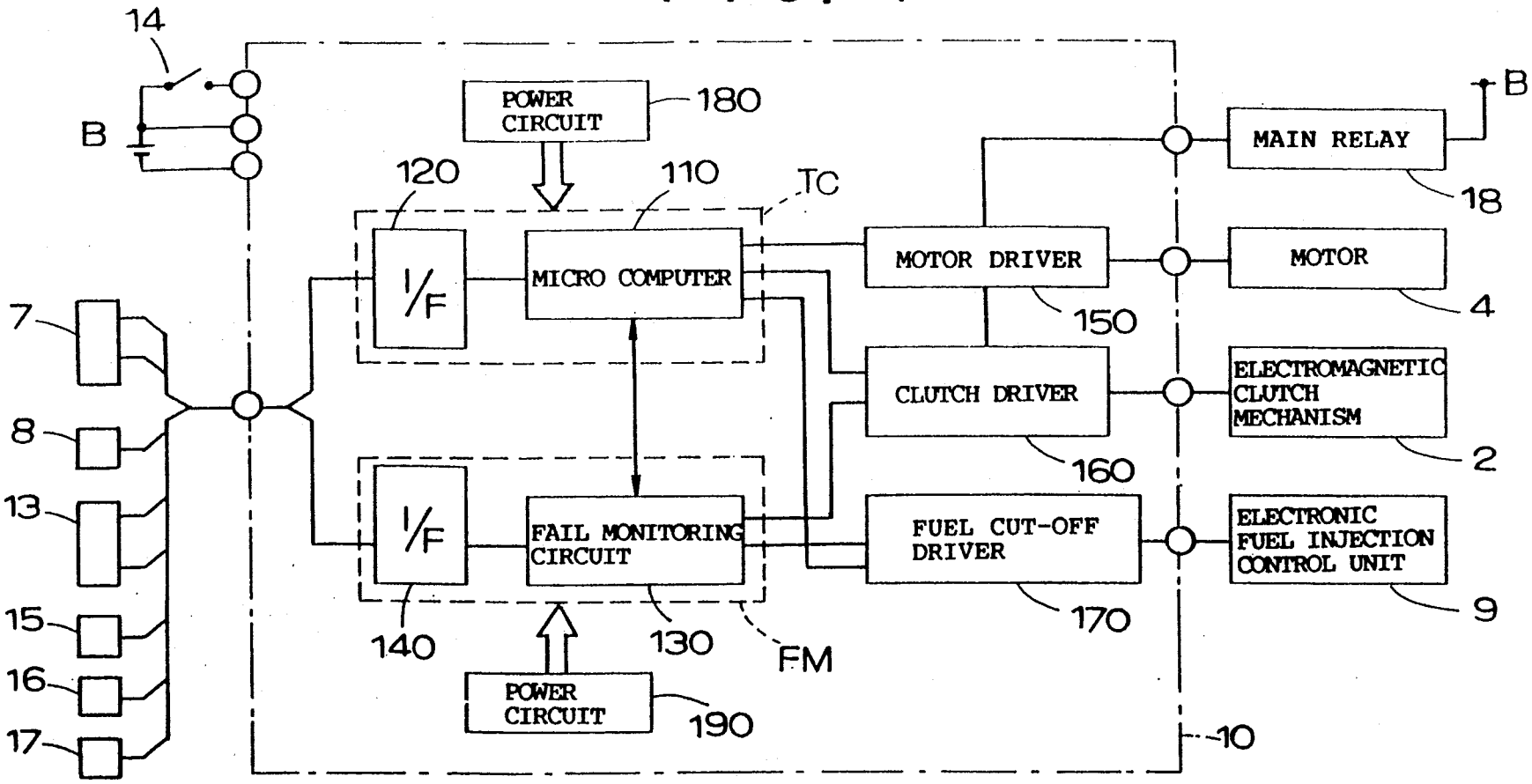
FIG. 1 is a block diagram of an electronic control unit in a throttle control apparatus according to an embodiment of the present invention.

The control unit 10 is provided with a control circuit having a microcomputer and mounted on a vehicle to receive output signals from various sensors as shown in FIG. 1 to perform various controls including the control of the electromagnetic clutch mechanism 2 and that of the motor 4. According to the present embodiment, the control unit 10 is arranged to control various systems such as an acceleration slip control system and an automatic speed control system for controlling a vehicle to run at a constant speed, in addition to a conventional control system performed in accordance with the operation of the accelerator pedal 5.

As shown in FIG. 1, the control unit 10 is provided with a throttle control section TC which includes a microcomputer 110 and an interface 120, and a fail monitoring section FM which includes a fail monitoring circuit 130 and an interface 140. These sections are electrically connected to the motor 4 and the electromagnetic clutch mechanism 2 through a motor driver 150 and a clutch driver 160. A fuel cut-off driver 170 is electrically connected to an electronic fuel injection control unit 9, connected to the microcomputer 110 and fail monitoring circuit 130. The throttle control section TC and fail monitoring section FM are electrically connected to power circuits 180, 190, respectively. The motor driver 150 and the clutch driver 160 are connected to a battery B through a main relay 18. The control unit 10 is connected to an ignition switch 14 of the internal combustion engine, and directly connected to the battery B to provide a power source for the circuits in the control unit 10. Electrically connected to the interfaces 120, 140 are the accelerator sensor 7, throttle sensor 13 and accelerator pedal switch 8. A brake pedal switch 15, a parking brake switch 16, and an automatic speed control switch 17 are also electrically connected to the interfaces 120, 140.

The automatic speed control switch 17 includes a main switch (not shown) which turns on and off the whole system of the automatic speed control system, and a control switch (not shown) which comprises a plurality of switches to perform various functions. For example, when a vehicle is running, if the main switch is turned on and a set switch in the control switch is turned on for a short period of time, then the vehicle speed will be memorized and retained. That is, a desired throttle position, i.e., a desired opening angle, is determined in accordance with a difference between a vehicle speed detected by the wheel speed sensor (not shown) and a vehicle speed provided by the set switch in the automatic speed control switch 17, and then the throttle valve 11 is rotated by the motor 4 to provide the desired throttle position. On the contrary, the automatic speed control will be canceled, when a brake pedal (not shown) is depressed, when an automatic transmission (not shown) is shifted to its neutral position, when a parking brake (not shown) is operated, when the main switch (not shown) is turned off, or the like.

The electromagnetic clutch mechanism 2 is energized or de-energized in accordance with a driving condition of the vehicle by the throttle control section TC and the circuits electrically connected thereto in the control unit 10, and also the motor 4 is operated thereby so as to provide the opening angle of the throttle valve 11, i.e., the throttle position, which is determined in accordance with the depressed amount of the accelerator pedal 5, i.e., the accelerator operating amount, and various factors. In the throttle control section TC and fail monitoring section FM, the operating conditions in the accelerator system and throttle control system are monitored on the basis of the output signals of the above-described sensors, respectively. If any abnormality is detected, a certain fail-safe procedure will be taken in each section.

Figure 3:
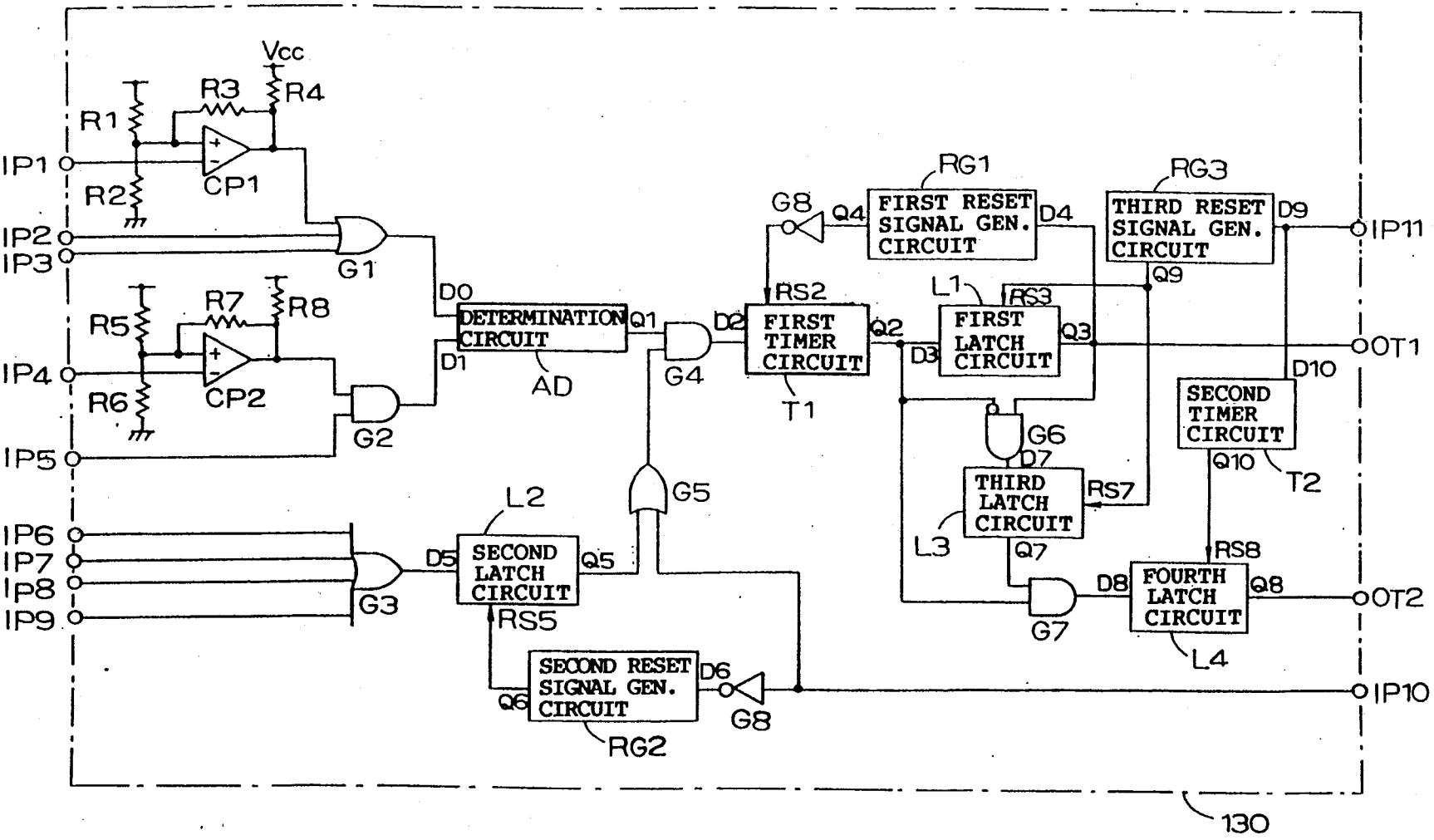
FIG. 3 is a block diagram of a fail monitoring circuit according to an embodiment of the present invention.

FIG. 3 shows an embodiment of the fail monitoring circuit 130, to which the output signals of the sensors are fed through input terminals IP1–IP9. In the accelerator system, the accelerator position signal is fed to the input terminal IP1, and the accelerator idle switch signal is fed to the input terminal IP2. The output signal of the accelerator pedal switch 8 is fed to the input terminal IP3. In the throttle control system, the throttle position signal is fed to the input terminal IP4 from the throttle sensor 7, and the throttle idle switch signal is fed to the input terminal IP5. For the automatic speed control, the output signal of the brake pedal switch 15 is fed to the input terminal IP6, and the output signal of the parking brake switch 16 is fed to the input terminal IP7. To the input terminals IP8, IP9, are fed other signals for providing the automatic speed control, such as a neutral switch signal from the automatic transmission.

An input signal fed to the input terminal IP1 is transmitted to the inverting input terminal of a comparator CP1 provided with resistors R1–R4. The input signal is compared with a certain voltage (Va) into which a constant voltage (Vcc) is divided by the resistors R1 and R2. A resultant output of the comparator CP1 is fed to an OR gate G1, along with the input signals fed to the input terminals IP2, IP3. Likewise, the input signal fed to the input terminal IP4 is transmitted to the inverting input terminal of a comparator CP2 provided with resistors R5–R8, and compared with a certain voltage (Vs) into which the constant voltage (Vcc) is divided by the resistors R5, R6. Then, a resultant output of the comparator CP2 is fed to an AND gate G2, along with the input signal to the input terminal IP5. The input signals fed to the input terminals IP6–IP9 are transmitted to an OR gate G3.

When at least one of the input signals fed to the input terminals IP1–IP3 is at a high level, the OR gate G1 will produce a high level signal. Namely, when the accelerator amount is less than a predetermined amount so that the output of the accelerator sensor 7 is less than the voltage (Va), the high level signal will be fed to the OR gate G1. When the accelerator idle switch is in its ON condition, the high level signal will be fed to the input terminal IP2, and when the accelerator pedal switch 8 is in its ON condition, the high level signal will be fed to the input terminal IP3. Whereas, when the throttle valve 11 is fully closed, i.e., when the output of the throttle sensor 13 is less than the voltage (Vs) and the throttle idle switch is in its ON condition, the AND gate G2 will produce the high level signal.

Figure 4:
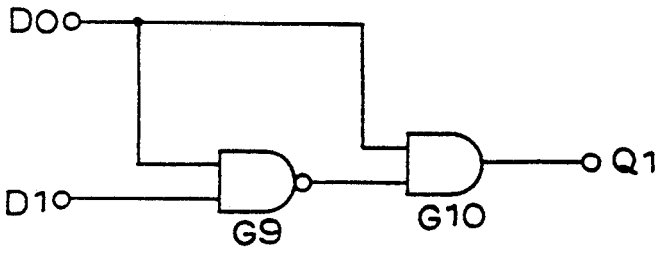
FIG. 4 is a diagram of a determination circuit according to an embodiment of the present invention.

Outputs of the OR gate G1 and the AND gate G2 are fed to input terminals D0, D1 of a determination circuit AD, which will produce the high level signal from an output terminal Q1 only when the OR gate G1 is at the high level and the AND gate G2 is at a low level. As shown in FIG. 4, the determination circuit AD includes a NAND gate G9 and an AND gate G10, and will produce the high level signal from the output terminal Q1, when the high level signal is fed from the OR gate G1 to the input terminal D0, and the low level signal is fed from the AND gate G2 to the input terminal D1, whereas it will produce the low level signal from the output terminal Q1, when the high level signal is fed to the input terminal D0 and the high level signal is fed to the input terminal D1. In the case where the low level signal is fed to the input terminal D0, when the low level signal is fed to the input terminal D1, the output terminal Q1 will output the low level signal, and also when the high level signal is fed to the input terminal D1, the output terminal Q1 will output the low level signal. Accordingly, if the throttle valve is not fully closed while the accelerator pedal 5 is in its original position, the output terminal Q1 will output the high level signal to provide a signal indicative of an abnormality, otherwise it will output the low level signal indicative of a normal condition.

Referring back to FIG. 3, it is determined by an AND gate G4 whether the output of the determination circuit AD is transmitted to a first timer circuit T1 depending on a level (high or low) of the output signal of an OR gate G5. That is, in the case where the vehicle is under the automatic speed control operation so that the OR gate G5 produces the low level signal as described later, the AND gate G4 will always produce the low level signal irrespective of the level (high or low) of the output of the determination circuit AD. When the automatic speed control operation is canceled to produce the high level signal from the OR gate G5, the output of the determination circuit AD will be transmitted to the AND gate G4 to become the output thereof.

Figure 5:
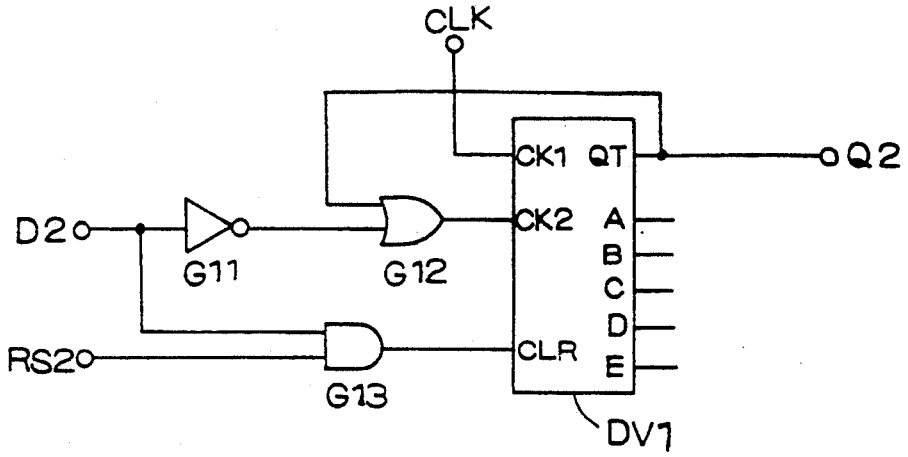
FIG. 5 is a diagram illustrating a first timer circuit according to an embodiment of the present invention.

The first timer circuit T1 includes a NAND gate G11, an OR gate 12, an AND gate G13 and a divider DV1 as shown in FIG. 5. The divider DV1 is arranged to input a clock pulse of a square wave from a terminal CLK to a terminal CK1 when a terminal CK2 receives the low level signal, and divide the pulse in accordance with a dividing ratio set by terminals A-E to transmit it to an output terminal Q2 from a terminal QT. When the high level signal is fed to the terminal CK2, the terminal QT will retain the condition of its output signal. When the low level signal is fed to the clear terminal CLR, the terminal QT will output the low level signal and clear its internal latch circuit. Accordingly, when the high level signal of the determination circuit AD is fed to the input terminal D2, an internal timer starts counting a time, and when a predetermined time period td elapses, the terminal QT will output the high level signal. On the contrary, when the low level signal is fed to the input terminal D2, or when the low level signal is fed to a reset terminal RS2, the internal timer will be cleared. The predetermined time period td is set for avoiding to determine that an abnormality has occurred during a delaying time period from the time when the motor 4 is activated to start closing the throttle valve 11 with the accelerator pedal 5 released suddenly, to the time when the throttle valve 11 is fully closed actually.

Figure 6:
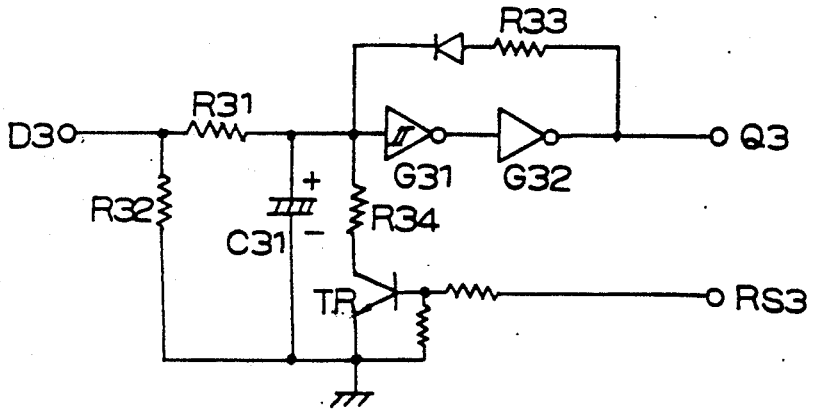
FIG. 6 is a diagram illustrating a first latch circuit according to an embodiment of the present invention.

The output terminal Q2 of the first timer circuit T1 is connected to an input terminal D3 of a first latch circuit L1 as shown in FIG. 3, and an output terminal Q3 thereof is connected to an output terminal QT1 which outputs a signal for de-energizing the electromagnetic clutch mechanism 2. In the first latch circuit L1 as shown in FIG. 6, when the high level signal is fed to the input terminal D3, a condenser C31 is charged through a resistor R31 to raise its electric potential. When the potential exceeds a threshold level of a schmidt inverter G31, an output thereof will be inverted and an output of an inverter G32 will be also inverted, while the condenser C31 is fixed to a potential divided by the resistors 31 and 32, so that the output terminal Q3 will be held to output the high level signal. When the high level signal is fed to the reset terminal RS3, a transistor TR will conduct, and the condenser C31 will be discharged through the resistor 34 and the transistor TR, so that the output terminal Q3 will output the low level signal. If the ignition switch 14 is turned off in such a condition that the condenser C31 has been charged, it will be discharged through the resistors R31, R32. Thus, in order to avoid a malfunction due to a noise, the above-described discharge circuit has been employed in the present embodiment, rather than edge trigger circuits such as a flip flop. Each of the second, third and fourth latch circuits L2, L3 and L4 as shown in FIG. 3 is the substantially same as the first latch circuit L1.

Figure 7:
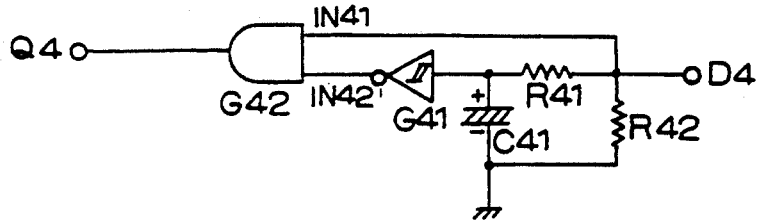
FIG. 7 is a diagram illustrating a first reset signal generating circuit according to an embodiment of the present invention.
Figure 8:
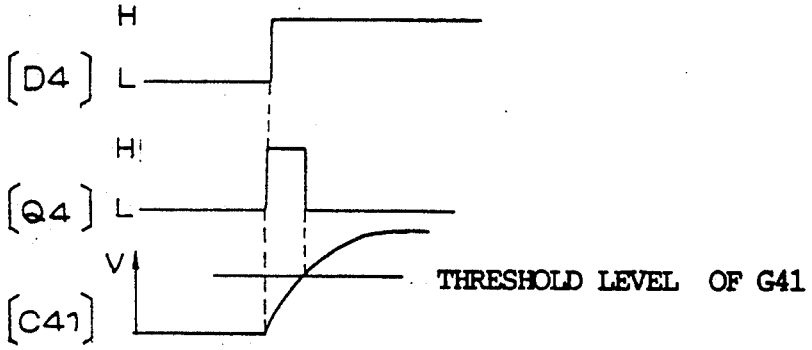
FIG. 8 is a timechart showing the operation in the first reset signal generating circuit according to an embodiment of the present invention.

The first latch circuit L1 outputs to a first reset signal generating circuit RG1 whose output is fed to a reset terminal RS2 of the first timer circuit T1 through an inverter G8. In the first reset signal generating circuit RG1 as shown in FIG. 7, when the high level signal is fed from the output terminal Q3 of the first latch circuit L1 to an input terminal D4, the high level signal will be fed to an input terminal IN41 of an AND gate G42, but a condenser C41 has not been charged. Therefore, the high level signal will be fed to an input terminal 42, so that an output terminal Q4 will output the high level signal. When the potential of the condenser C41 exceeds the threshold level of the schmidt inverter G41 as shown in FIG. 8, the output of the AND gate G42 will be inverted to cause the output terminal Q4 to output the low level signal. That is, the output terminal Q4 will output a reset signal as shown in FIG. 8, wherein "H" indicates the high level, "L" indicates the low level and "V" indicates the voltage. On the contrary, when the low level signal is fed to the input terminal D4, the condenser C41 will be discharged through the resistor R41. The second and third reset generating circuits RG2 and RG3 as shown in FIG. 3 are the substantially same as that shown in FIG. 7. Thus, when the high level signal indicative of the abnormality is fed from the first latch circuit L1 to the first reset signal generating circuit RG1, the reset signal (high level signal) will be produced therefrom, and inverted at the inverter G8, so that the low level signal will be fed to the reset terminal RS2 of the first timer circuit T1. Consequently, the internal timer of the first timer circuit T1 will be cleared.

Each signal input to the input terminals IP6-IP9 is fed to the OR gate G3, and will become the high level signal when any one of the brake pedal switch 15, parking brake switch 16 and the like is turned on. This high level signal is held at the second latch circuit L2 and fed to the OR gate G5. The input terminal IP10, which will receive the low level signal when the automatic speed control switch 17 is turned on, is connected to the OR gate G5 and the inverter G8. Therefore, when the low level signal is fed to the input terminal IP10, the OR gate G5 will produce the low level signal, and the low level signal will be inverted at the inverter G8 to output the high level reset signal to the input terminal D6 of the second reset signal generating circuit RG2, so that the reset signal will be fed to the reset terminal RS5 of the second latch circuit L2.

The output of the first latch circuit L1 is fed to the AND gate G6, and the output of the first timer circuit T1 is inverted to input to the AND gate G6. An output of the AND gate G6 is fed to an input terminal D7 of the third latch circuit L3 whose output is fed to an AND gate G7, to which the output of the first timer circuit T1 is also fed. Then, the output of the AND gate G7 is fed to the fourth latch circuit L4 to provide an output signal from an output terminal OT2, which is connected to the fuel cut-off driver 170 as shown in FIG. 1. When the high level signal is fed to the fuel cut-off driver 170, it will produce a signal for cutting off the supply of fuel to the electronic fuel injection control unit 9.

An input terminal IP11 for receiving an initial check signal is connected to an input terminal D9 of a third reset signal generating circuit RG3, and connected to an input terminal D10 of a second timer circuit T2. An output terminal Q9 of the third reset signal generating circuit RG3 is connected to a reset terminal RS3 of the first latch circuit L1, and a reset terminal RS7 of the third latch circuit L3. An initial check signal is the low level signal during an initial checking operation, and will become the high level signal after the initial checking operation is terminated.

Figure 9:
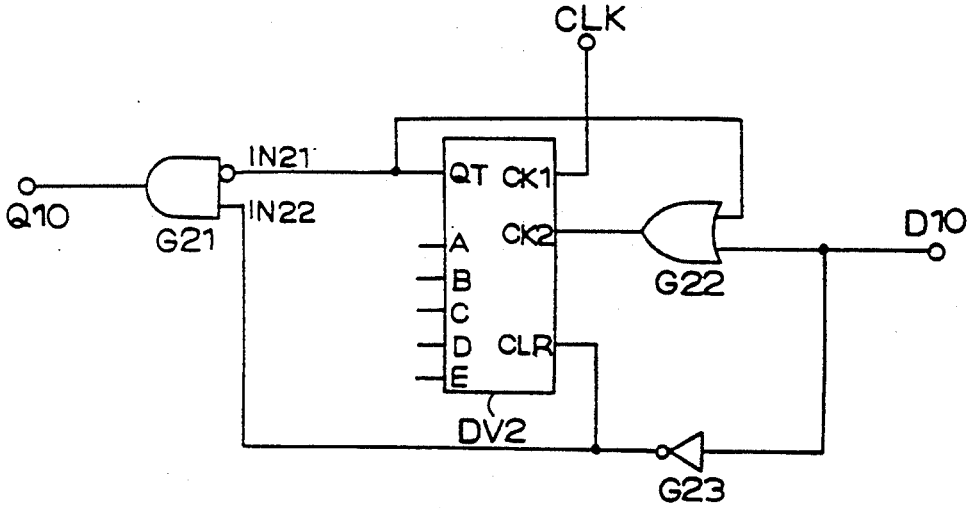
FIG. 9 is a diagram illustrating a second timer circuit according to an embodiment of the present invention.
Figure 10:
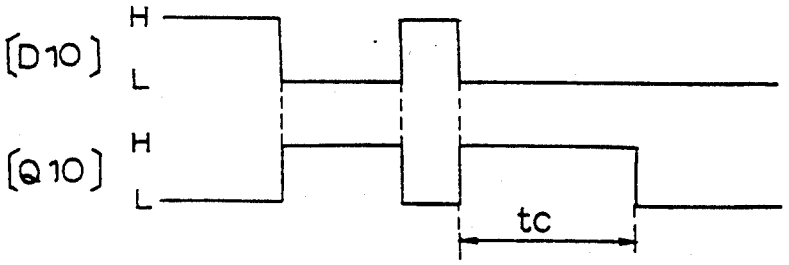
FIG. 10 is a timechart showing the operation in the second timer circuit according to an embodiment of the present invention.

Referring to FIG. 9, the second timer circuit T2 includes an AND gate G21, an OR gate G22, an inverter G23 and a divider DV2, and operates as shown in FIG. 10. When the low level signal is fed to an input terminal D10, the high level signal will be fed to an input terminal IN22 of the AND gate G21. Then, an internal timer of the divider DV2 will start. Until a predetermined time period tc elapses, the low level signal is fed to the input terminal IN21, so that the high level signal is fed to the AND gate circuit G21. When the high level signal is fed to the input terminal D10, the low level signal will be fed to the input terminal IN22, so that the AND gate G21 will produce the low level signal. After the predetermined time period tc elapses, the internal timer will output the high level signal to the input terminal IN21 to cause the AND gate G21 to produce the low level signal. The output terminal Q10 of the second timer circuit T2 is connected to a reset terminal RS8 of the fourth latch circuit L4, as shown in FIG. 3.

Figure 11:
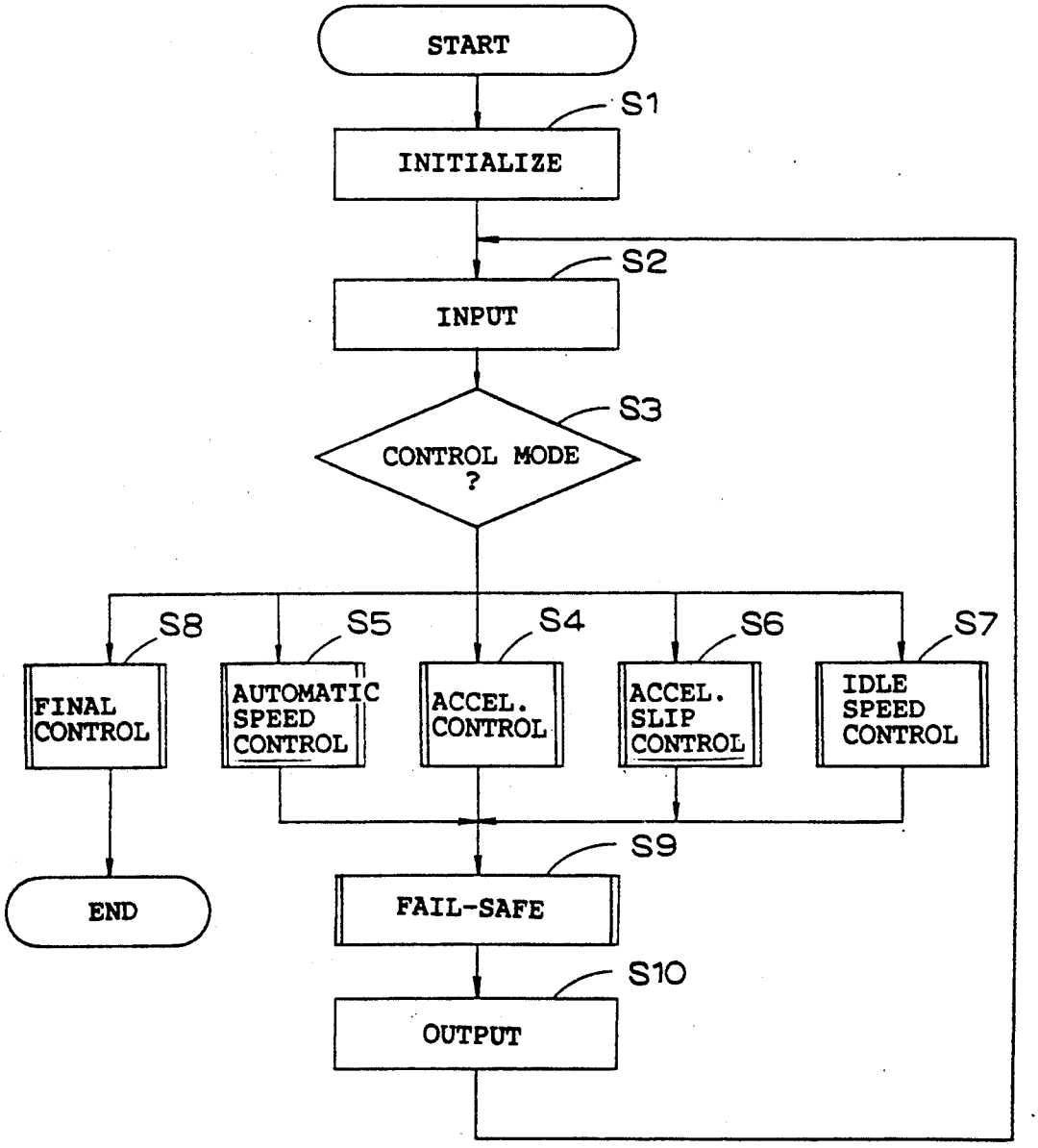
FIG. 11 is a flowchart showing the overall operation of a throttle control section according to an embodiment of the present invention.

Next will be explained the operation of the above-described embodiment. FIG. 11 shows a flowchart of a program routine executed for the overall operation of the throttle control section TC according to the present embodiment. The program provides for initialization of the system at Step S1, and various input signals are fed to the interface 120 at Step S2, and then a control mode is selected at Step S3 in accordance with the input signals, i.e., one of Steps S4–S8 is selected. In the case where the Steps S4–S6 are executed, a fail-safe control is performed at Step S9, and then the program proceeds to Step S10 where the electromagnetic clutch mechanism 2 and motor 4 are actuated by the clutch driver 160 and the motor driver 150, respectively. At Step S7, an idle speed control is performed for maintaining the idle speed at a constant speed irrespective of a condition of the engine. Step S8 is provided for the operation which will be performed after the ignition switch 14 is turned off. At Step S9, the various signals input through the interface 120 are monitored, and if it is determined that there is an abnormality in the system, the throttle valve 11 will be disengaged from the motor 4, and/or the supply of fuel to the fuel injection control unit 9 will be cut off.

A normal accelerator control executed at Step S4 will be described hereinafter with reference to FIGS. 1 and 2. When the electromagnetic clutch mechanism 2 is energized by the clutch driver 160 in accordance with a signal from the throttle control section TC of the electronic control unit 10, the rotational force of the motor 4 can be transmitted to the throttle shaft 12 through the gear mechanism 3 and the electromagnetic clutch mechanism 2. Thereafter, except for the abnormality described later, the throttle shaft 12 will be rotated by the motor 4 to adjust the throttle valve 11 to be positioned at a predetermined opening angle.

More specifically, when the accelerator pedal 5 is depressed in the normal accelerator control operation, the accelerator position signal corresponding to the accelerator amount, i.e., the depressed amount of the accelerator pedal 5 is fed from the accelerator sensor 7 to the control unit 10, and a desired throttle opening angle is determined in the throttle control section TC in accordance with the accelerator amount. Then, when the throttle shaft 12 is rotated by the motor 4, the throttle position signal corresponding to the rotational angle of the throttle shaft 12 will be fed from the throttle sensor 13 to the control unit 10, which will actuate the motor 4 through the motor driver 150 so as to rotate the throttle valve 11 to be positioned at the desired throttle opening angle. Thus, the throttle opening angle is controlled in accordance with the depressed amount of the accelerator pedal 5, so that an engine power corresponding to the opening angle of the throttle valve 11 is obtained. As described above, without any mechanical connection between the accelerator pedal 5 and the throttle valve 11, it is possible to start and run the vehicle smoothly in response to depression of the accelerator pedal 5. When the accelerator pedal 5 is released, the throttle valve 11 is fully closed by a biasing force of the return spring (not shown) and the rotational force of the motor 4.

According to the present embodiment, the fail-safe control is performed in the fail monitoring section FM in addition to that performed at Step S9. That is, in case of the normal acceleration control operation when an abnormality is detected in the fail monitoring section FM, the electromagnetic clutch mechanism 2 will be de-energized, or the supply of fuel to the engine will be cut off. In operation, when a vehicle driver releases the depressing force applied to the accelerator pedal 5 to terminate the accelerating operation, the accelerator position signal, which is fed from the accelerator sensor 7 to the input terminal IP1, will become the high level signal, and the accelerator idle switch in the accelerator sensor 7 will be turned on to input the high level signal to the input terminal IP2. Furthermore, the accelerator pedal switch 8 is turned on to input the high level signal to the input terminal IP3. Consequently, it is determined by the high level signal fed to the OR gate G1 that the accelerator control operation is terminated, and therefore the OR gate G1 will produce the high level signal. If the opening angle of the throttle valve 11 still exceeds the predetermined throttle opening angle in the above condition, the throttle position signal fed from the throttle sensor 13 to the input terminal IP4 will become the low level signal, and the throttle idle switch is off, so that the low level signal will be fed to the input terminal IP5, and therefore the AND gate G2 will produce the low level signal. Accordingly, the high level signal will be fed to the input terminal D0 of the determination circuit AD, and the low level signal will be fed to the input terminal D1, so that the output terminal Q1 will output the high level signal indicative of the abnormality.

In this case, if the vehicle is not under the automatic speed control operation, the OR gate G5 will produce the high level signal, so that the output signal of the AND gate G4 will be dependent on the output of the determination circuit AD. Also, when the braking operation is performed to turn on the brake pedal switch 15, and the automatic speed control operation is canceled, the OR gate G5 will produce the high level signal. When the high level signal of the determination circuit AD is fed to the first timer circuit T1 through the AND gate G4, the high level signal indicative of the abnormality will be fed to the input terminal D3 of the first latch circuit L1 with a predetermined time period td delayed. Thus, the first timer circuit T1 constitutes the abnormality detecting circuit according to the present invention, whereby an erroneous determination can be avoided after the depressing force to the accelerator pedal 5 was released, and until the motor 4 is actuated to close the throttle valve 11.

The high level signal indicative of the abnormality is latched at the first latch circuit L1, and fed from the output terminal OT1 to the clutch driver 160 to de-energize the electromagnetic clutch mechanism 2, so that the throttle valve 11 will be disengaged from the motor 4. At this time, the rest signal is fed from the first reset signal generating circuit RG1 to the first timer circuit T1 to clear the internal timer thereof. Therefore, in the case where the accelerator control operation is terminated, if it is determined that there is an abnormality, the throttle valve 11 will be forced to return to its initial position. Since the first latch circuit L1 hold the output signal at the high level until the ignition switch 14 is turned off, the throttle valve 11 is held to be disengaged from the motor 4 until the ignition switch is turned off, so that the throttle control operation by means of the motor 4 is not performed.

The high level signal indicative of the abnormality is fed from the first latch circuit L1 to the AND gate G6. When the first timer circuit T1 is cleared once to produce the low level signal, the AND gate G6 will produce the high level signal, so that the high level output will be held in the third latch circuit L3 to be fed to the AND gate G7. And, when the first timer circuit T1 produces the high level signal again after the predetermined time period td has been lapsed, the AND gate G7 will produce the high level signal, so that the high level output will be held in the fourth latch circuit L4 to be fed to the fuel cut-off driver 170. Consequently, the supply of fuel to the engine by the electronic fuel injection control unit 9 is cut off. Thus, in the case where the signal indicative of the abnormality is still produced, when more than the predetermined time period td has been lapsed after the signal indicative of the abnormality was produced and the clutch driver 160 was actuated, the fuel cut-off driver 170 will be actuated to cut off the supply of fuel. Since the first, second and fourth latch circuits L1, L2 and L4 are latched until the ignition switch 14 is turned off, the supply of fuel will not be initiated again even if the accelerator control operation is performed. It is the reason why the supply of fuel is cut off when the time period td has been lapsed after the signal indicative of the abnormality was produced, that it takes a time to fully open the throttle valve by means of the return spring after the signal indicative of the abnormality was produced and the throttle valve 11 was disengaged from the electromagnetic clutch mechanism 2, and therefore it shall be avoided to cut off the supply of fuel for that time period.

Next will be explained the automatic speed control operation, wherein the throttle valve 11 is rotated by the motor 4 when the accelerator pedal 5 is not operated and positioned at the initial position thereof. Thus, the fail monitoring circuit 130 must be prohibited from operating in case of the automatic speed control operation. According to the present embodiment, therefore, when the automatic speed control operation is initiated, the low level signal will be fed to the input terminal IP10, so that the low level signal will be fed from the OR gate G5 to the AND gate G4. Consequently, the AND gate G4 will generate the low level signal irrespective of the output level of the determination circuit AD to be determined as a normal operation. When the braking operation is made, for example, the automatic speed control operation will be terminated, and the OR gate G3 will generate the high level signal, so that the high level signal will be fed from the OR gate G5 to the AND gate G4. Then, the output of the determination circuit AD will be transmitted to the AND gate G4 to become the output thereof. When the automatic speed control is performed again, the OR gate G5 will generate the low level signal and the second latch circuit L2 will be reset.

When the ignition switch 14 is turned on, the operation of each circuit and device will be checked for an initial check operation. At the time of the initial check operation, the throttle valve 11 will be rotated by the motor 4 even if the accelerator pedal 5 is positioned at its initial position. In order that the signal indicative of the abnormality is never generated during the initial check operation, the apparatus is controlled to operate as follows. At the time of the initial check operation, the low level signal is fed to the input terminal IP11 and also the low level signal is fed to the second timer circuit T2, the internal timer thereof starts and holds the signal at the high level for a predetermined time period tc, and the fourth latch circuit L4 is reset until the predetermined time period tc elapses, or the high level signal is fed to the input terminal IP11. Thus, the fuel cut-off driver 170 is not operated for the predetermined time period tc after the initial check operation started, so that the supply of fuel is not cut off during that period. When the high level signal is fed to the terminal IP11 after the initial check operation, the reset signal will be fed from the third reset signal generating circuit RG3 to the first and third latch circuits L1 and L3 to reset them.

According to the present embodiment, since it is required for the determination of the abnormality that the accelerator pedal 5 has been returned to its initial position, the intention of the vehicle driver is reflected in responding the abnormality. In addition, when the abnormality is detected the engine is not immediately stopped, but only the throttle control operation by means of the motor 4 is stopped. Therefore, it is possible to operate the throttle valve 11 manually and continue operating the engine to pull the vehicle to a garage for repairing it.

When the signal indicative of the abnormality is fed to the motor driver 150 and/or the clutch driver 160, the condition of the apparatus is held by means of each latch circuit until the ignition switch 14 is turned off, so that it is possible to effectively respond the abnormality. When the initial check operation or the automatic speed control operation is performed, it is necessary to actuate the motor 4 irrespective of the operation of the accelerator pedal 5. In this case, however, since the function of the fail monitoring circuit 130 is stopped temporarily, no malfunction will be caused. Further, the fail-safe is achieved by the throttle control section TC and the fail monitoring section FM in terms of both software and hardware, and also the redundancy system has been provided by means of various sensors, so that a better reliability is obtained. The fail monitoring section FM may be formed by providing an electric circuit irrespective of the microcomputer 110, so that the apparatus may be made easily and inexpensive.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. A throttle control apparatus for controlling an opening of a throttle valve disposed in an internal combustion engine, in response to operation of an accelerator operating mechanism, comprising:

throttle operating means for opening and closing said throttle valve in accordance with an amount of operation of said accelerator operating mechanism;

clutch means disposed between said throttle operating means and said throttle valve for selectively taking one of a first position of said throttle operating means engaged with said throttle valve and a second position of said throttle operating means disengaged from said throttle valve;

control means for controlling said clutch means to selectively take one of the first position and the second position, said control means controlling the operation of said throttle operating means at least in response to the operation of said accelerator operating mechanism;

first detection means for detecting the amount of operation of said accelerator operating mechanism to produce a first signal corresponding to the amount of operation of said accelerator operating mechanism;

second detection means for detecting an opening angle of said throttle valve to produce a second signal corresponding to the opening angle of said throttle valve;

determination means for determining if there is an abnormality, in which said throttle valve opens at an angle more than a predetermined opening angle when said accelerator operating mechanism is positioned substantially at an initial position thereof, in accordance with the first signal fed from said first detection means and the second signal fed from said second detection means; and abnormality detecting means connected to said determination means for producing a signal indicative of the abnormality when the abnormality continues for a period of time more than a predetermined time period; and means for causing said clutch means to take the second position for disengaging said throttle operating means from said throttle valve when the signal indicative of the abnormality is produced by said abnormality detecting means.

2. An apparatus as set forth in claim 1, wherein said clutch means continues taking the second position for disengaging said throttle operating means from said throttle valve, until an ignition switch for said engine is turned off.

3. An apparatus as set forth in claim 2, further comprising reset signal generating means for generating a reset signal which prohibits said abnormality detecting means from producing the signal indicative of the abnormality for a predetermined period of time after said ignition switch is turned on.

4. An apparatus as set forth in claim 1, wherein said internal combustion engine is provided with fuel supply means for controlling an amount of fuel supplied to said internal combustion engine, and wherein said apparatus further comprises means for causing said fuel supply means to cut off the supply of fuel to said internal combustion engine, when said abnormality detecting means continues producing the signal indicative of the abnormality after said clutch means disengages said throttle operating means from said throttle valve.

5. An apparatus as set forth in claim 4, wherein said clutch means continues taking the second position for disengaging said throttle operating means from said throttle valve, and said fuel supply means continues cutting off the supply of fuel to said internal combustion engine, until an ignition switch for said engine is turned off.

6. An apparatus as set forth in claim 5, further comprising reset signal generating means for generating a reset signal which prohibits said abnormality detecting means from producing the signal indicative of the abnormality for a predetermined period of time after said ignition switch is turned on.

7. An apparatus as set forth in claim 1, wherein said internal combustion engine is provided with automatic speed control means for automatically maintaining a vehicle speed at a constant speed by controlling said throttle operating means, and wherein said abnormality detecting means prohibits the signal indicative of the abnormality from being produced when said automatic speed control means is operating to maintain the vehicle speed at the constant speed.

8. An apparatus as set forth in claim 1, wherein said accelerator operating mechanism includes an accelerator pedal, and wherein said first detection means includes an accelerator sensor for producing the first signal corresponding to a depressed amount of said accelerator pedal, and an accelerator pedal switch for producing an initial position signal indicative of a free position of said accelerator pedal.

9. An apparatus as set forth in claim 1, wherein said second detection means includes a throttle sensor for producing the second signal corresponding to the opening angle of said throttle valve, said throttle sensor being provided with a throttle idle switch for producing an initial position signal indicative of a fully closed position of said throttle valve.

10. A throttle control apparatus for controlling an opening of a throttle valve disposed in an internal combustion engine, in response to operation of an accelerator operating mechanism, comprising:

a motor for opening and closing said throttle valve in accordance with an amount of operation of said accelerator operating mechanism;

an electromagnetic clutch mechanism disposed between said motor and said throttle valve for selectively taking one of a first position of said motor engaged with said throttle valve and a second position of said motor disengaged from said throttle valve;

a control circuit for controlling said electromagnetic clutch mechanism to selectively take one of the first position and the second position, said control circuit controlling the operation of said motor at least in response to the operation of said accelerator operating mechanism;

a first detector for detecting the amount of operation of said accelerator operating mechanism to produce a first signal corresponding to the amount of operation of said accelerator operating mechanism;

a second detector for detecting an opening angle of said throttle valve to produce a second signal corresponding to the opening angle of said throttle valve;

a fail monitoring circuit connected to said first detector and second detector, and connected to said motor and electromagnetic clutch mechanism in parallel with said control circuit, said fail monitoring circuit including an abnormality detecting circuit for determining if there is an abnormality, in which said throttle valve opens at an angle more than a predetermined opening angle when said accelerator operating mechanism is positioned substantially at an initial position thereof, in accordance with the first signal fed from said first detector and the second signal fed from said second detector, and producing a signal indicative of the abnormality when the abnormality continues for a period of time more than a predetermined time period, and said fail monitoring circuit causing said electromagnetic clutch mechanism to take the second position for disengaging said motor from said throttle valve when the signal indicative of the abnormality is produced by said abnormality detecting circuit.

11. An apparatus as set forth in claim 10, wherein said accelerator operating mechanism includes an accelerator pedal, and wherein said first detector includes an accelerator sensor for producing the first signal corresponding to a depressed amount of said accelerator pedal and an accelerator pedal switch for producing a first initial position signal indicative of a free position of said accelerator pedal, and wherein said second detector includes a throttle sensor for producing the second signal corresponding to the opening angle of said throttle valve, said throttle sensor being provided with a throttle idle switch for producing a second initial position signal indicative of a fully closed position of said throttle valve.

12. An apparatus as set forth in claim 11, wherein said abnormality detecting circuit includes a first gate circuit connected to said first detector for producing a first gate signal when said first signal is less than a first predetermined value, or when said first gate circuit receives the first initial position signal, and a second gate circuit connected to said second detector for producing a second gate signal when said second signal is less than a second predetermined value and said second gate circuit receives the second initial position signal, and wherein said abnormality detecting circuit includes a determination circuit connected to said first gate circuit and second gate circuit for producing a fail signal, when said first gate signal is fed to said determination circuit, but said second gate signal is not fed thereto, and said abnormality detecting circuit includes a first timer circuit connected to said determination circuit for producing the signal indicative of the abnormality when said determination circuit continues producing the fail signal for the period of time more than the predetermined time period.

13. An apparatus as set forth in claim 10, wherein said internal combustion engine is provided with fuel supply means for controlling an amount of fuel supplied to said internal combustion engine, wherein said fail monitoring circuit produces a cut-off signal when said abnormality detecting circuit continues producing the signal indicative of the abnormality after said electromagnetic clutch mechanism disengages said motor from said throttle valve, and wherein said apparatus further comprises a fuel cut-off driver for causing said fuel supply means to cut off the supply of fuel to said internal combustion engine in accordance with the cut-off signal fed from said abnormality detecting circuit.

14. An apparatus as set forth in claim 13, wherein said fail monitoring circuit further comprises a latch circuit for maintaining the cut-off signal until said ignition switch is turned off.

15. An apparatus as set forth in claim 14, wherein said fail monitoring circuit further comprises a reset circuit for prohibiting said latch circuit from maintaining the cut-off signal for a predetermined time period after said ignition switch is turned on.

16. An apparatus as set forth in claim 10, wherein said fail monitoring circuit further comprises a latch circuit for maintaining the signal indicative of the abnormality until said ignition switch is turned off.

17. An apparatus as set forth in claim 16, wherein said fail monitoring circuit further comprises a reset circuit for prohibiting said latch circuit from maintaining the signal indicative of the abnormality for a predetermined time period after said ignition switch is turned on.

18. An apparatus as set forth in claim 10, wherein said internal combustion engine is provided with automatic speed control means for automatically maintaining a vehicle speed at a constant speed by controlling said motor, and wherein said fail monitoring circuit further comprises a reset circuit for prohibiting said abnormality detecting circuit from producing the signal indicative of the abnormality when said automatic speed control means is operating to maintain the vehicle speed at the constant speed.

* * * * *